US006878932B1

(12) United States Patent
Kroska

(10) Patent No.: US 6,878,932 B1
(45) Date of Patent: Apr. 12, 2005

(54) MASS SPECTROMETER IONIZATION SOURCE AND RELATED METHODS

(76) Inventor: John D. Kroska, 23960 NE Fillmore St., East Bethel, MN (US) 55005

( * ) Notice: Subject to any disclaimer, the term of this patent is extended or adjusted under 35 U.S.C. 154(b) by 0 days.

(21) Appl. No.: 10/435,312

(22) Filed: May 9, 2003

(51) Int. Cl.[7] ..... H01J 49/04
(52) U.S. Cl. ..... 250/288
(58) Field of Search ..... 250/288, 427, 250/423 R; 134/3; 205/218, 205, 206, 219, 247

(56) References Cited

U.S. PATENT DOCUMENTS 4,659,438 A * 4/1987 Kuhn et al. ..... 205/218
4,755,265 A 7/1988 Young
5,055,678 A * 10/1991 Taylor et al. ..... 250/291
5,083,450 A * 1/1992 Grindstaff ..... 73/23.25
5,217,586 A 6/1993 Datta et al.
5,400,665 A * 3/1995 Zhu et al. ..... 250/288
5,406,318 A 4/1995 Moore et al.
5,437,179 A 8/1995 Wiegand et al.
5,589,630 A 12/1996 Wiegand et al.
5,601,785 A 2/1997 Higdon
5,686,656 A 11/1997 Amirav et al.
5,702,671 A 12/1997 Gerstel
5,736,739 A 4/1998 Uber et al.
5,778,681 A 7/1998 Li et al.
5,796,100 A 8/1998 Palermo
5,903,344 A 5/1999 Reedy
5,970,804 A 10/1999 Robbat et al.
6,037,587 A 3/2000 Dowell et al.
6,125,709 A 10/2000 Van Der Maas
6,150,279 A 11/2000 Ku
6,412,751 B1 7/2002 Wang
6,498,042 B1 12/2002 Wilson
6,621,076 B1 * 9/2003 van de Goor et al. ..... 250/288
2002/0158016 A1 10/2002 Norberg et al.

* cited by examiner

*Primary Examiner*—Jack I. Berman
(74) *Attorney, Agent, or Firm*—William R. Berggren

(57) ABSTRACT

An improved ionization source for a mass spectrometer is constructed of stainless steel, electropolished, and electroplated with gold. Operation of a mass spectrometer with the improved ionization source results in reduced adsorption and reduced reactions between charged molecules or ions and metallic surfaces. Micro-machining before electropolishing enhances smoothness, brightness, passivation and inertness of the improved ionization source. Use of the electropolished, gold-electroplated stainless steel ionization source in a mass spectrometer reduces adsorption, degradation and decomposition of the analyte and reduces adverse ion/surface reactions, as compared to use of a conventional stainless steel ionization source. A method of reducing adsorption, degradation and decomposition of the analyte and reducing adverse ion/surface reactions in an ionization source containing an electropolished and gold-electroplated ionization source for a mass spectrometer is also disclosed. The improved ionization source remains serviceable for longer periods and is easier to clean and recondition for continued use as compared conventional mass spectrometer ionization sources.

31 Claims, 4 Drawing Sheets

| Mass | Abund | Rel Abund | Iso Mass | Iso Abund | Iso Ratio |
|---|---|---|---|---|---|
| 69.05 | 1358336 | 100.00 | 70.05 | 15536 | 1.14 |
| 218.95 | 715968 | 52.71 | 219.95 | 32304 | 4.51 |
| 502.05 | 85448 | 6.29 | 503.05 | 9753 | 11.41 |

MASS SPECTROMETER IONIZATION SOURCE AND RELATED METHODS

FIELD OF THE INVENTION

This invention relates to improvements in mass spectrometry and more specifically relates to improvements to an ionization source that allow analysis that is more sensitive and provide other analytical and operational advantages.

BACKGROUND OF THE INVENTION

Mass spectrometer (MS) instruments analyze compounds and mixtures by measuring the mass-to-charge ratio (M/Z) of ionized molecules generated at a source. Mass spectrometers vaporize and ionize a sample and determine the mass-to-charge ratio of the resulting ions. Time-of-flight (TOF) and ion trap are types of mass spectrometers.

A mass spectrometer system generally consists of a gas chromatograph (GC) or alternate device to introduce an analyte for analysis; an ionization source with a chamber to produce ions from the analyte; a mass analyzer or filter to separate ions according to their mass-to-charge ratio; a detector to measure ion abundance; and an instrument control and data-handling system to produce a mass spectrum of the analyte.

In the operation of an MS, an ionization source generates charged molecules for mass identification. Ionization sources useful in mass spectrometry include, for example electron impact (EI), chemical ionization (CI), negative chemical ionization (NID), fast ion or atom bombardment, field desorption, laser desorption, plasma desorption, thermospray, electrospray and inductively coupled plasma. A problem typically encountered with an EI ionization source has been that the mechanical components of a conventional EI ionization source use a magnetic or electrical field to focus ions to the filter or analyzing point. These mechanical components tend to be ignored, as the analyte is not analyzed in the source. However, it would be preferable to generate the charged molecules while maintaining inertness and mechanical integrity throughout the ion source.

A time-of-flight (TOF) mass spectrometer determines the mass-to-charge ratio of an ion by measuring the amount of time it takes a given ion to migrate from the ion source to the detector, under influence of electric fields. Time-of-flight (TOF) mass spectrometers accelerate a pulsed ion beam across a nearly constant potential and measure the flight time of ions from their origination at the source to a detector. Since the kinetic energy per charge of an ion is nearly constant, heavier ions move more slowly and arrive at the detector later in time than lighter ions. Using the flight times of ions with known M/Z values, the TOF spectrometer is calibrated and the flight time of an unknown ion is converted into an M/Z value. TOF mass spectrometers have been primarily used with pulsed sources generating a discrete burst of ions. Examples of mass, spectrometers with pulsed sources include plasma desorption mass spectrometers and secondary ionization mass spectrometers. Ionization methods include matrix assisted laser desorption/ionization (MALDI) and electrospray ionization (ESI).

An ion trap mass spectrometer has a ring electrode and a pair of end cap electrodes, which form an ion trap region. The ion trap mass spectrometer operates with an electron impact (EI) ion source including an ionization step and a mass-analyzing step. In the ionization step, a sample in an ion trap region ionizes by collision with electrons, and resulting ions accumulate in the ion trap region. In the a mass analyzing step, the ion trap region consecutively ejects accumulated ions by radio frequency (RF) voltage scanning applied to the electrodes, and a detector detects the ejected ions.

An analyte in gaseous form is introduced into the chamber containing the ionization source, and the ionization source partially ionizes the analyte. As previously mentioned, illustrative ionization sources useful in mass spectrometry include, for example: EI, CI, NID, fast ion or atom bombardment, field desorption, laser desorption, plasma desorption, thermospray, electrospray and inductively coupled plasma. Two accepted and widely used ionization sources to create ions in mass spectrometers are EI and CI ionization sources.

In an EI ionization source of a conventional mass spectrometer, introduction of an electron beam creates charged molecules. The EI source generally contains a heated filament to emit electrons that accelerate toward an anode and collide with gaseous analyte molecules introduced into the ionization chamber. The beam of emitted electrons focuses in the ionization chamber where the analyte is introduced. Typically, relatively high-energy electrons (of about 70 eV) collide with molecules of the subject analyte, producing ions with an efficiency of less than a few percent. These collisions produce primarily positive ions. Upon ionization, the molecules of a given substance fragment in predictable patterns. The resultant ions separate by their mass-to-charge ratio in the mass analyzer or filter and collect in the detector. EI is a direct process; energy transfers collisionally from electrons to analyte molecules. Total pressure within the EI ionization source is normally less than about $10^{-1}$ torr. The ions produced are extracted from the EI source with an applied electric field and generally do; not collide with other molecules or surfaces from their formation in the EI source until their collection in the detector.

The surfaces of the analyte area or chamber containing the ionization source are highly susceptible to analyte absorption. Molecular interactions between the introduced analyte and the surfaces of the chamber and the ionization source can distort the true quantity and quality of the presented analyte. Due to temperature, vacuum, and electrical considerations, metal surfaces (such as stainless steel) have typically been used for construction of the ionization source. It has long been desired to provide a greater degree of mechanical isolation between the charged molecular beam and the adsorptive surfaces of the chamber and the ionization source.

In ion traps and ion sources, ions that are formed by electron impact within the ionization chamber or trap rarely interact with the surfaces of the chamber or trap. As such, it is not usually necessary to prevent adsorption, degradation or decomposition of analyte ions or to prevent adverse reactions of gaseous ions on the surface. Any such secondary ions are not detected and do not interfere with or affect the intended measurement. Modification of the neutral analyte by hot surfaces prior to electron impact caused the degradation of concern in ion traps and ion sources.

After formation of ions in the ionization source, five basic types of mass analyzers or filters are available for ion separation, including magnetic, electrostatic, time-of-flight, ion cyclotron resonance, quadrupole, and variations of the quadrupole. Typical detectors used in mass spectrometers are discrete and continuous dyanode electron multipliers.

Other workers have made efforts to address analyte degradation problems in an MS ionization chamber by substituting or modifying ionization chamber surfaces. For example, chromium or oxidized chromium surfaces in an analyte analyzing and ionizing apparatus, such as an ion trap or ionization chamber, have been used to prevent degradation or decomposition of an analyte in contact with those surfaces. An inert, inorganic, non-metallic insulator or semiconductor coating material on the ion trap or ionization chamber interior surfaces has been used to reduce adsorption, degradation or decomposition of an analyte in contact with the surface. Silicon coated steel has also been used in place of certified stainless steel with some reported improvement in results. Furthermore, coating the inner surface of the ionization with chamber materials known for corrosion resistance or inertness, such as nickel, rhodium, and the like, may retard degradation of some analytes.

Other attempts to prevent degradation problems involve treating the inner metal surfaces of the analytical apparatus with a passivating agent to mask or destroy active surface sites. For example, gas chromatographic injectors, chromatographic columns, transfer lines, and detectors have been treated with alkylchlorosilanes and other silylizing agents. Such treatments have had some success in deactivating metal surfaces and preventing degradation. Unfortunately, the materials used for such treatments have sufficiently high vapor pressure, produce gas phase organic materials within the ionization chamber volume, and ionize along with the analyte, producing a high chemical background in the mass spectrum. Mass spectrometers using such ionization chambers give variable results and do not completely prevent analyte degradation over time. Some mass spectrometer manufacturers gold plate the quadrupole surfaces but this does not involve any electropolishing techniques.

In addition to metal surface degradation problems just described, currently available ionization sources tend to corrode or degrade over extended periods and require, cleaning and reconditioning for continued use. Often cleaning procedures include aggressive mechanical abrading procedures that can stress, deform or even break affected portions of the ionization source. Such procedures result in extended equipment downtime and often result in breakage of the involved parts, requiring costly replacement.

DESCRIPTION OF THE INVENTION

Figure 1:
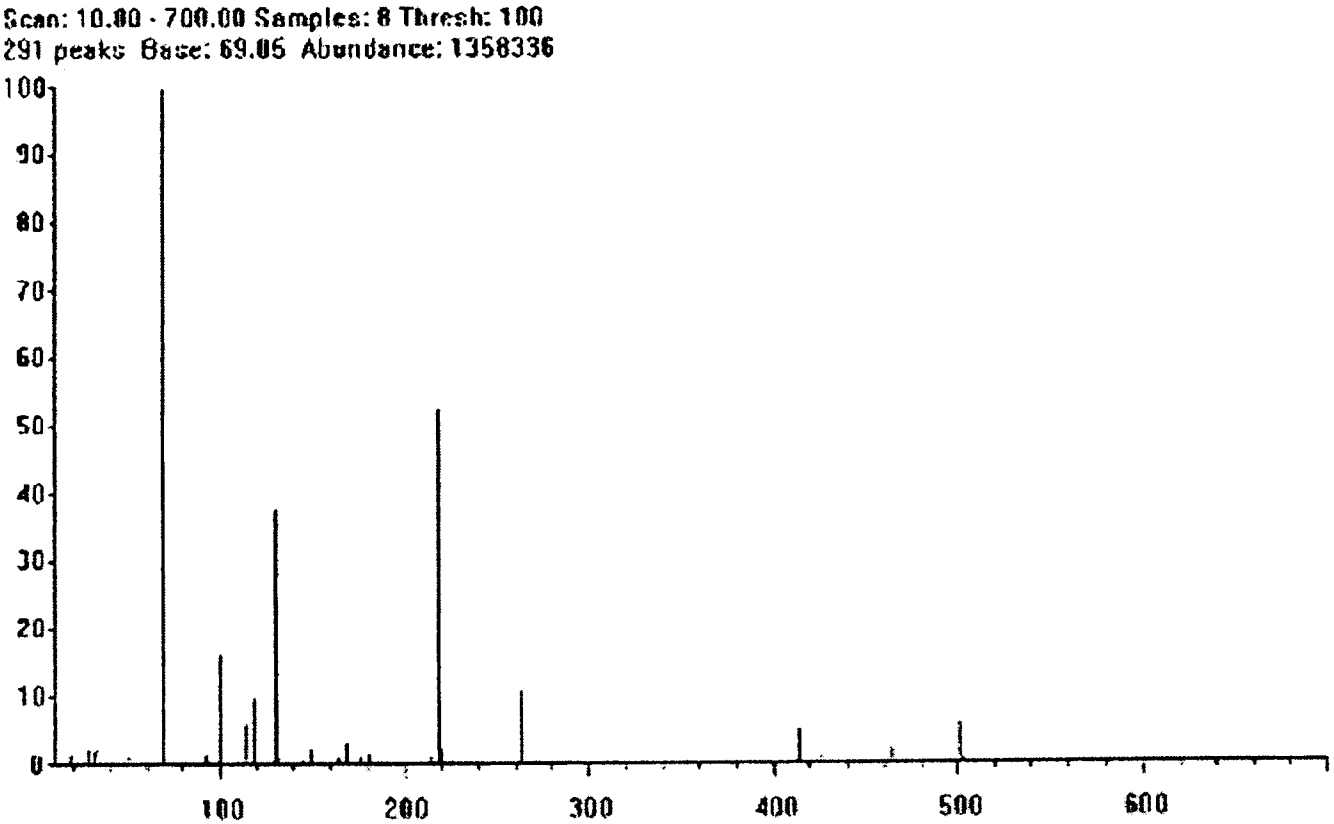
FIG. 1 is a graph showing analysis of a standard calibration compound using a conventional stainless steel EI ionization source in a mass spectrometer.

This invention concerns improvements to an ionization source or other source of ions for an MS, such as an EI ionization source. It has been discovered that by electropolishing the surface of a stainless steel ionization source and then electroplating the electropolished surface with gold, the surface of the ionization source is more stable and smoother than comparable ionization sources and evidences less interaction with analytes. The use of the electropolished and gold-electroplated stainless steel ionization source reduces analyte adsorption, degradation or decomposition and reduces adverse reactions of gaseous ions on the chamber inner surfaces to improve mass spectrometer performance. In addition, the electropolished and gold-electroplated stainless steel ionization source can be used for longer periods before requiring cleaning and rehabilitation, and cleaning is a simplified procedure that avoids abrasive techniques.

The presently described novel MS ionization source according to this invention has a very smooth and inert surface and maintains enhanced inertness over extended periods of use. As used throughout this description and in the appended claims, the terms "ionization chamber," "ionization source," "source of ions," and the like terms may be used interchangeably and are intended to be given their broadest interpretation. These terms are to be understood to define any structure that will generate ions from an analyte or analysis standard by fragmentation for detection within an MS.

This improved ionization source is prepared by constructing an ionization source of the desired configuration from non-magnetic stainless steel. The stainless steel used may be a certified grade of 303 non-magnetic surgical stainless steel. Stainless steel is micro-machined by any industry standard micro-machining technique, such as machining or "turning off" the outer stainless steel layer (sometimes referred to as the "bark") and then heat-treating the micro-machined blank. The micro-machined blank is heat treated or stabilized by any industry standard technique. Suitably, the micro-machined blank can be heated to an elevated temperature, for example, about 300° to; about 350° C. for about 2 hours. After cooling, standard techniques, including lathe turning, are used to complete the desired configuration of the ionization source. The micro finish of the ionization source should be of grade 16 or better, so the molecular beam can be as smooth and reproducible as possible.

Any industry standard electropolishing method is then used to electropolish the ionization source. For example, a suitable electropolishing method involves applying a current in an acid bath to remove surface materials. Other suitable methods of polishing include chemical passivation polishing, mechanical abrasive polishing, cylindering, honing, and metal-to-metal polishing. The steel used for the ionization source must contain nickel or chromium in order to be electropolished. The resulting surface is very smooth and bright, and the chromium component of the stainless steel is readily seen.

Electropolishing is electrolytic removal of metal in a highly ionic solution by electrical potential and current. Electropolishing removes a very thin material layer from a metal part or component. The process enhances workpiece material properties and changes physical dimensions, depending upon the metal itself and processing before electropolishing. Most ferrous and non-ferrous metals can be electropolished. Electropolishing smoothes and levels most metal surfaces, improving visual appearance. Smoothing levels metal grain boundaries, removing sites for potential stress cracking, enhancing a part's strength.

In electropolishing of stainless steel, a stainless steel workpiece connects to an electrical rectifier positive side and functions as an anode. The workpiece is placed in an electropolishing bath, usually phosphoric and sulfuric acid.

The cathode connects to the rectifier negative end to receive metal ions from the workpiece. A thick viscous electropolishing solution film, known as anode film, forms on the workpiece surface during electropolishing. Metal dissolves anodically through a highly polarizing film in steady state metal ion removal.

As current is applied to the workpiece anode, the electropolishing solution thickens and functions as an insulator or resistor. Greater film thickness leads to higher resistance or insulation properties. The metal closest to the workpiece surface has a very thick anode solution film and is electrically insulated from the cathode. Higher surface irregularities or peaks protrude from the work surface through the anode film. The highest peaks have the least insulation from the anode film and receive a proportionally greater current from the cathode, dissolving faster than lower peaks. Medium peaks receive a lower current than the higher peaks and dissolve more slowly. The differential dissolution rates create the electropolishing leveling effect.

Electropolishing removes metal surface high spots or peaks. Higher peak dimensions change drastically while lower peak dimensions change very little, creating a metal surface smoothing effect. Workpiece dimensional reduction can be very small, about 0.00025 in. Following electropolishing, a DI water rinse removes the polarizing film.

Electropolishing stainless steel also removes free iron from the workpiece surface, eliminating free iron corrosion, and enriching the surface with chromium and nickel. Chromium forms a chromium oxide passivation layer over the metal surface adding corrosion resistance.

The resulting electropolished ionization source is then nickel flashed by; any industry standard nickel flashing method. Illustratively, immersing the ionization source in a bath of hydrochloric acid with application of a small-pulsed current is a suitable nickel flashing method. Nickel flashing of the electropolished stainless steel ionization source is required before the following gold electroplating. Typically, the nickel flashing should have a thickness of no more than about 0.000001 inch or thinner.

The final step in constructing the novel ionization source of this invention is gold electroplating. Any industry standard method of electroplating gold may be used and a suitable thickness of the gold finish has been found to be from about 0.000030 inch to about 0.000050 inch. Suitable gold-plating techniques include electrodeposition and sputtering. Gold plating of the electropolished stainless ionization source provides enhanced inertness and smoothness. Gold plating of the interior ion chamber surfaces of the ionization source (i.e., the analyte-contacting surfaces) provides the inertness and other desired advantages reported for the present invention. However, gold plating only, the ion chamber would be a more expensive and complicated procedure, requiring such time-consuming and expensive techniques as masking of the ionization source exterior surfaces. In addition, gold plating of the entire ionization source simplifies cleaning the ionization source, described further below.

Several unexpected benefits have been observed to result from the use of a novel ionization source of this invention in place of a conventional ionization source. Use of the improved ionization source allows high mass throughput efficiency for the analyte or analysis standard. The improved ionization source can remain in service in an MS for longer periods, has greater inertness and is easier to clean than a conventional ionization source. For example, FIGS. 1 through 4, as further described below, serve to illustrate benefits observed from use of a novel electropolished, gold-electroplated EI ionization source of this invention in place of a conventional stainless steel EI ionization source in a mass spectrometer.

FIG. 1 is a graph showing analysis of FC43, a standard calibration compound, using a conventional stainless steel EI ionization source in a 5973A mass spectrometer, manufactured by Agilent Technologies, Wilmington, Del. FC43 is chemically identified as perfluorotributylamine. In the legend below the graph, "MASS" is the fragmentation of FC43, "ABUND" is the raw mass fragmentation counts of FC43, "REL ABUND" is the percentage of efficiency of fragmentation and transmission from the source to the analyzer of FC43, "ISO MASS" is the isotope mass of $C_{13}$, and "ISO RATIO" is the isotope ratio of $C_{12}$ to $C_{13}$.

Figure 2:
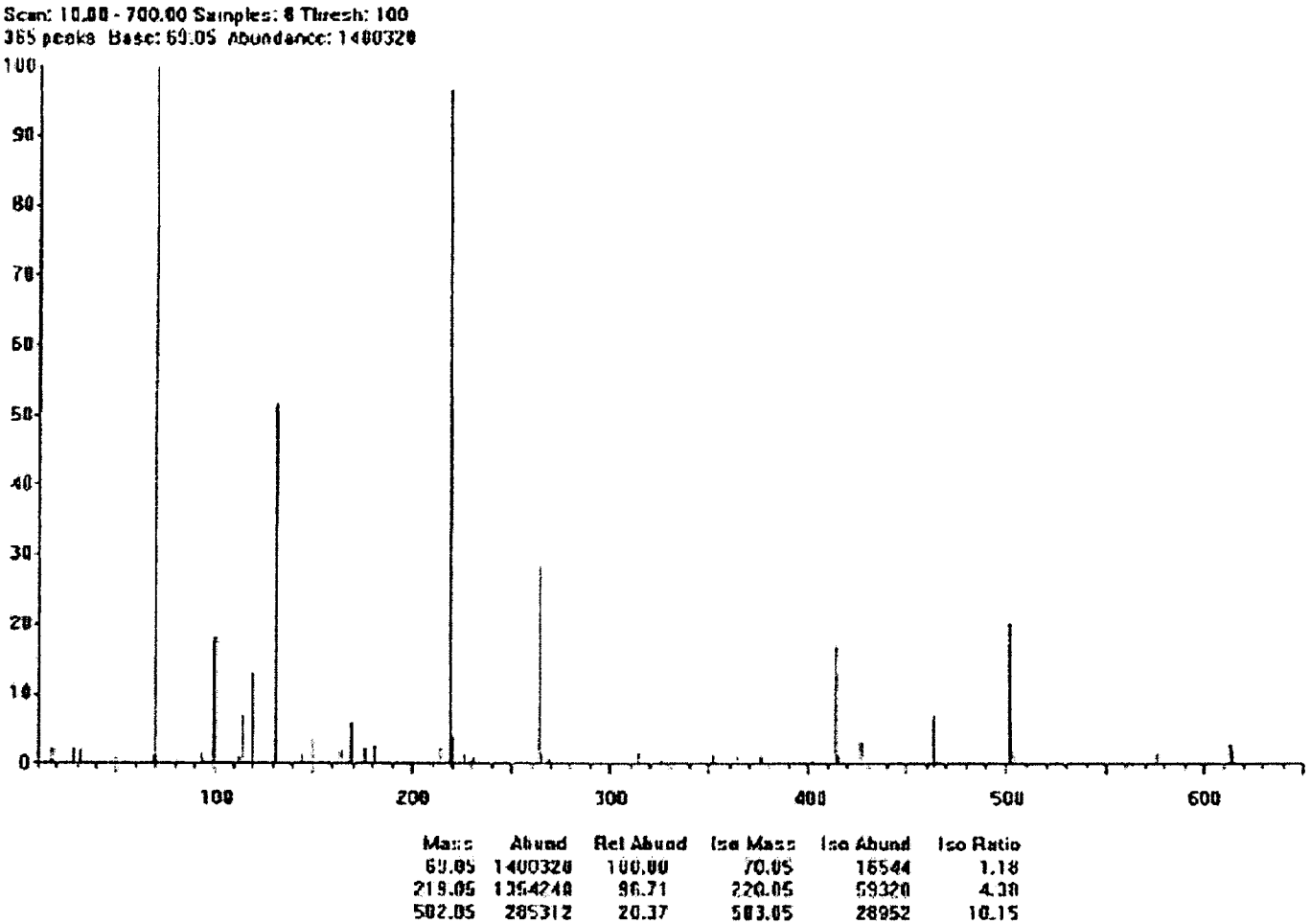
FIG. 2 is a graph showing analysis of the same standard calibration compound identified for FIG. 1 using an electropolished, gold-electroplated stainless steel EI ionization source of this invention in the same mass spectrometer identified for FIG. 1.

FIG. 2 is a graph showing analysis of the same standard calibration compound identified for FIG. 1 using an electropolished, gold-electroplated stainless steel EI ionization source of this invention in the same mass spectrometer described for FIG. 1. The standard calibration compound and the interpretation for the legend below the graph are as described for FIG. 1. As can be seen by comparing the graphs of FIGS. 1 and 2, the tuning and mass transmission quality of the spectral pattern using the electropolished, gold-electroplated stainless steel ionization source of this invention provides increased transmitted mass, allowing better library searching, and enhanced tuning for the MS as compared to use of a conventional stainless steel ionization source. Using the electropolished, gold-electroplated stainless steel EI ionization source of this invention, the MS is tuned for higher sensitivity and efficiency.

Figure 3:
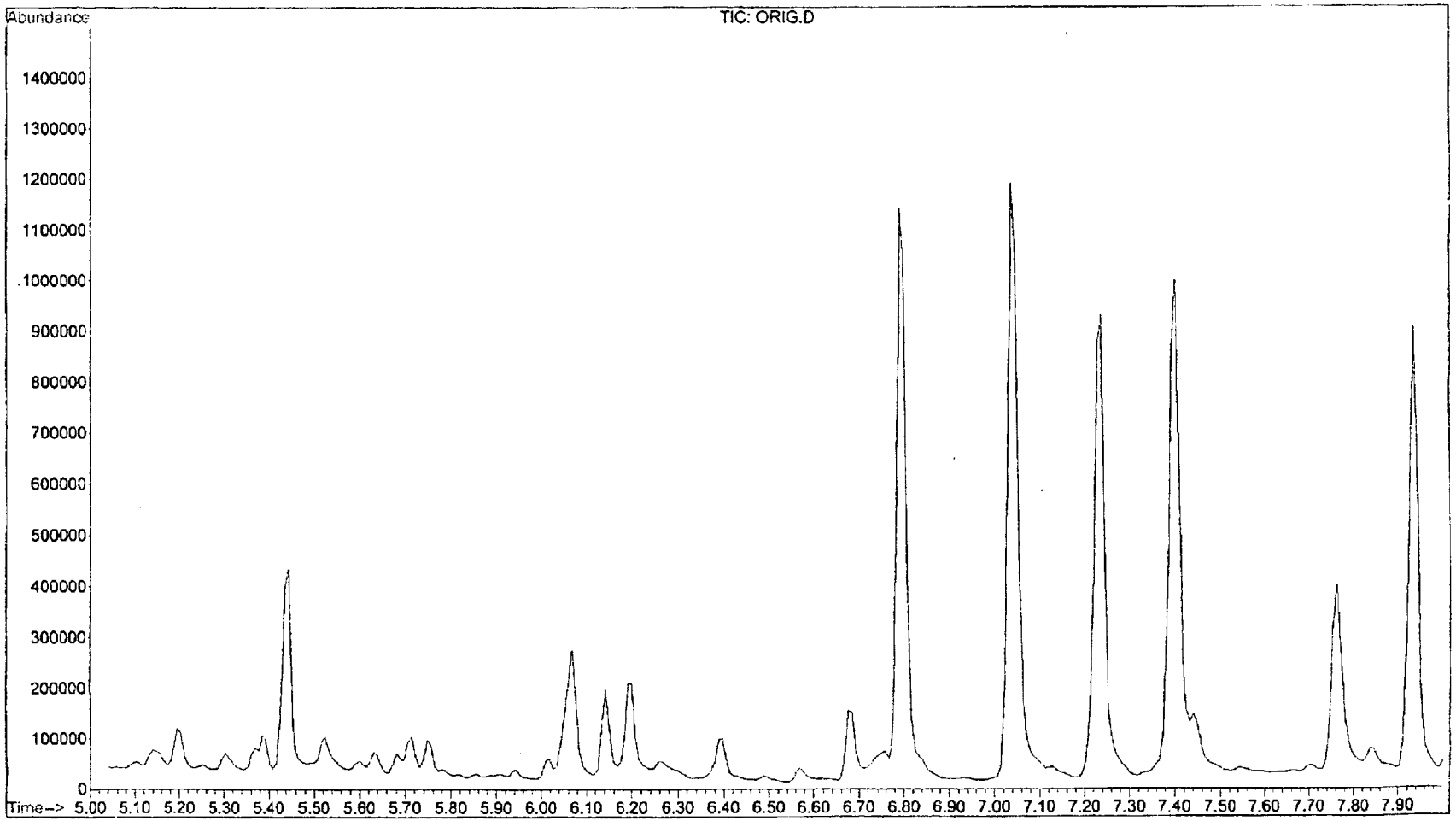
FIG. 3 is a graph showing analysis of a typical food and drug analysis standard used for governmental food inspections, using a conventional stainless steel EI ionization source in a mass spectrometer.

FIG. 3 is a graph showing analysis of 10 ppm of a typical food and drug, analysis standard used by Canadian national government agencies for food inspections, using a conventional stainless steel EI ionization source in a 5972A mass spectrometer, manufactured by Agilent Technologies, Wilmington, Del. Data displayed in FIG. 3 is for a selected portion or time period of a chromatographic run to display graphically a portion of the analysis of this standard.

Figure 4:
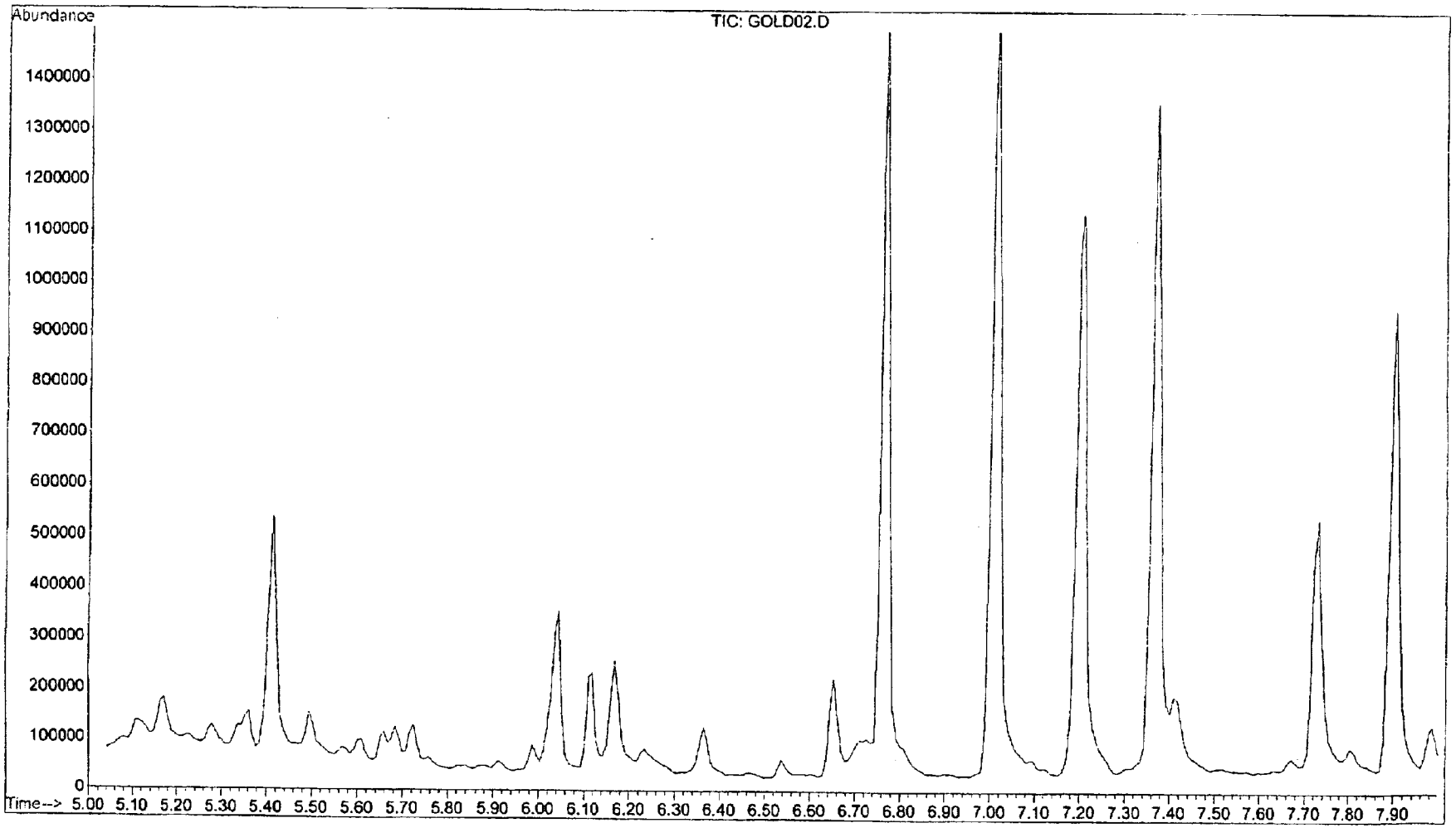
FIG. 4 is a graph showing analysis of the same food and drug analysis standard identified for FIG. 3, using an electropolished and gold-electroplated EI ionization source in the same mass spectrometer identified for FIG. 3.

FIG. 4 is a graph showing analysis of 10 ppm of the same food and drug analysis standard as described for FIG. 3, using an electropolished, gold-electroplated EI ionization source in the same mass spectrometer identified for FIG. 3. Data displayed in FIG. 4 is for the same selected time period as shown in FIG. 3 during a chromatographic run to display graphically the same portion of the analysis of this same standard, using an ionization source of this invention. A comparison of FIGS. 3 and 4 shows increased response and improved signal-to-noise using the electropolished, gold-electroplated ionization source of this invention (FIG. 4) as compared to the conventional stainless steel ionization source (FIG. 3). FIG. 4 shows improved (lower) detectable limits for the compounds in this standard using the electropolished, gold-electroplated ionization source.

All ionization sources require cleaning after an extended period of use. Cleaning of conventional ionization sources typically requires mechanical abrasion, such as vigorous mechanical cleaning, abrasives, such as abrasive paper, alumina abrasive powder, sand blasting, and the like, and cleaning solvents, such as acetone, methanol, methylene chloride and the like. Such cleaning techniques are necessary to rehabilitate a conventional ionization source after extended use. Mechanical cleaning may often result in deformation or even breakage of the components, resulting in unwanted expense, time and effort. The novel EI ionization source of this invention is easily reconditioned with non-abrasive cleaning in conventional protic acid, such as sulfuric acid of about 3 N, and then rinsing with deionized water. No mechanical deformation of parts occurs in the process of cleaning or rehabilitating the inventive EI ionization source. Acid cleaning of conventional stainless steel ionization sources would etch and deform the steel, resulting in reduced ion beam efficiency upon reuse in an MS.

While this invention has been described and illustrated with reference to specific embodiments, those skilled in the art will recognize that modification and variations may be made without departing from the principles of the invention as described herein above. For example, although this invention has been exemplified with reference to an electron impact (EI) ionization source, similar advantages and improvements may result from the application of these principles to other ionization sources, including, for example, chemical ionization (CI), negative chemical ionization (NID), fast ion or atom bombardment, field desorption, laser desorption, plasma desorption, thermospray, electrospray and inductively coupled plasma, and the like. The full limits of this invention are as set forth in the following claims.

What is claimed is:

1. An analyte contacting element for a mass spectrometer, wherein the element has a finish selected from electropolished, chemical passivation polished, mechanical abrasive polished, cylindered, honed, and metal-to-metal polished finishes wherein the element additionally comprises a gold-electroplated surface with a thickness of between 0.000030 and 0.000050 inches.

2. An element according to claim 1, wherein the finish is an electropolished finish.

3. An element according to claim 1, wherein the element is an ionization source.

4. An element according to claim 1, wherein the element is an ionization chamber of an ionization source.

5. An element according to claim 1, wherein the element is comprised of stainless steel.

6. An element according to claim 1, wherein the element has a micro-machined finish.

7. An element according to claim 1, wherein the element is selected from electron impact, chemical ionization, negative chemical ionization, fast ion and atom bombardment, field desorption, laser desorption, plasma desorption, thermospray, electrospray, and inductively coupled plasma ionization sources.

8. An element according to claim 1, wherein the element is an electron impact ionization source.

9. An analyte contacting element for a mass spectrometer, wherein the element has a gold-electroplated surface with a thickness of between 0.000030 and 0.000050 inches and wherein the element comprises an ionization source.

10. A method comprising:

operating a mass spectrometer with an improved analyte contacting element, wherein the improved element has a finish selected from electropolished, chemical passivation polished, mechanical abrasive polished, cylindered, honed, and metal-to-metal polished finishes and a gold-electroplated surface with a thickness of between 0.000030 and 0.000050 inches.

11. A method according to claim 10, wherein the element is an ionization source.

12. A method according to claim 10, wherein the element is comprised of stainless steel.

13. A method according to claim 10, wherein the element has a micro-machined finish.

14. A method according to claim 10, wherein the element is comprised of a certified grade of non-magnetic stainless steel.

15. A method according to claim 10, wherein the element is selected from electron impact, chemical ionization, negative chemical ionization, fast ion and atom bombardment, field desorption, laser desorption, plasma desorption, thermospray, electrospray, and inductively coupled plasma ionization sources.

16. A method according to claim 10, wherein the element is an electron impact ionization source.

17. A mass spectrometer with an analyte contacting element that has a finish selected from electropolished, chemical passivation polished, mechanical abrasive polished, cylindered, honed, and metal-to-metal polished finishes; and additionally comprises a gold-electroplated surface able to approximately replicate the finish and with a thickness of between 0.000030 and 0.000050 inches.

18. A mass spectrometer according to claim 17, wherein the element is comprised of stainless steel.

19. A method comprising:

making an analyte contacting element for a mass spectrometer;

providing a finish for the element using a process selected from electropolished, chemical passivation polished, mechanical abrasive polished, cylindered, honed, and metal-to-metal polished finishes; and gold-electroplating the element to a thickness of between 0.000030 and 0.000050 inches following the providing of the finish.

20. A method according to claim 19, wherein the element is comprised of stainless steel.

21. A method according to claim 19, wherein the element is selected from electron impact, chemical ionization, negative chemical ionization, fast ion and atom bombardment, field desorption, laser desorption, plasma desorption, thermospray, electrospray, and inductively coupled plasma ionization sources.

22. A method according to claim 19, wherein the element is an ionization source.

23. An element according to claim 19, wherein the element is an ionization chamber of an ionization source.

24. A method according to claim 19, further comprising micro-machining the element before the providing of the finish.

25. A method according to claim 19, wherein the element is an electron impact ionization source.

26. A method of cleaning an analyte contacting element of a mass spectrometer contaminated with analyte-generated contamination comprising providing an element having a gold surface with to a thickness of between 0.000030 and 0.000050 inches and treating the element with acid to remove the analyte-generated contamination.

27. A method according to claim 26, free of use of abrasive materials or procedures.

28. A method according to claim 26, wherein the element is selected from electron impact, chemical ionization, negative chemical ionization, fast ion and atom bombardment, field desorption, laser desorption, plasma desorption, thermospray, electrospray, and inductively coupled plasma ionization sources.

29. A method according to claim 26, wherein the element is an ionization source.

30. A method according to claim 26, wherein the element is an electron impact ionization source.

31. A method according to claim 26, wherein the element has; a finish, selected from electropolished, chemical passivation polished, mechanical abrasive polished, cylindered, honed, and metal-to-metal polished finishes, and a gold-electroplated surface.

* * * * *